US005497521A

United States Patent [19]

Waits et al.

[11] Patent Number: 5,497,521

[45] Date of Patent: Mar. 12, 1996

[54] FOOT WARMER

[76] Inventors: Ronald L. Waits, 1122 Whisper Wind Dr., McDonough, Ga. 30253; Troy A. Craig, 118 Governors Park Dr., Forest Park, Ga. 30050

[21] Appl. No.: 489,544

[22] Filed: Jun. 12, 1995

[51] Int. Cl.[6] ..... A47C 21/00; A47G 9/00

[52] U.S. Cl. ..... 5/658; 5/482; 2/69.5

[58] Field of Search ..... 5/658, 485, 482, 5/648, 494, 413; 2/69, 69.5

[56] References Cited

U.S. PATENT DOCUMENTS

| | | | |
|---|---|---|---|
| 174,920 | 3/1876 | Milwain . | |
| 175,252 | 3/1876 | Milwain . | |
| 633,134 | 9/1899 | Hansen . | |
| 639,176 | 12/1899 | Kaffenberger . | |
| 857,507 | 6/1907 | Wilson | 5/494 |
| 1,811,821 | 6/1931 | Bloom | 2/69 |
| 1,964,271 | 6/1934 | O'Dwyer | 5/494 |
| 2,504,761 | 4/1950 | Turco | 5/485 |
| 2,705,325 | 4/1955 | Bogenberger | 2/69 |
| 2,850,617 | 9/1958 | Coldren | 5/648 |
| 3,638,251 | 2/1972 | Weiss . | |
| 3,824,640 | 7/1974 | Golden . | |
| 4,627,123 | 12/1986 | Uggerud | 5/485 |
| 4,903,360 | 2/1990 | Friedman | 5/494 |
| 4,916,756 | 4/1990 | Barrett | 5/485 |

*Primary Examiner*—Alexander Grosz
*Attorney, Agent, or Firm*—Rodgers & Rodgers

[57] ABSTRACT

A foot warmer for use in combination with a conventional bed comprises a fabric pocket adapted to receive a user's feet and which is secured to the bed by attachment strap disposed between the mattress and box springs.

2 Claims, 1 Drawing Sheet

FOOT WARMER

BACKGROUND OF THE INVENTION

During the winter months and especially in colder climates, the need to keep warm is a pervasive problem. This becomes particularly acute when an individual retires for the evening. Conventional bedding including sheets, blankets, bedspread, comforter, etc., when-used in total, can become quite cumbersome to the user and some individual's feet are quite sensitive to the extra weight of multiple covers. In particular, one's feet, being outer extremities of the body, are more prone to becoming cold especially during the inactive time when one is in bed. In order to solve the cold feet syndrome, normally, one simply adds additional layers of covers to a degree sufficient to warm the feet. Of course, when the feet are finally sufficiently warm, the remainder of the body can become uncomfortably warm. In persons with medical conditions such as circulatory problems and diabetes, cold feet are chronically a problem and, in environments such as hospitals and nursing homes, conventional full body covering may not be practical.

Known efforts to solve this problem have centered around various methods of modifying existing bedsheets and/or covers by permanently attaching additional components normally in the form of a pocket-like feature for the purpose of receiving one's feet. Of course, such an arrangement is expensive and makes it more difficult to make up a bed. Also, such arrangements, being permanently affixed to bedsheets and covers, eliminate the ability to utilize conventional bedsheets and covers if additional foot warmth is desired.

SUMMARY OF THE INVENTION

According to this invention, a foot warmer is provided which, in combination with a bed having a mattress and box springs, provides additional warmth for a user's feet and comprises a fabric pocket having a width approximately equal to the width of the bed and having attachment means extending downwardly from the sides of the pocket under the mattress and above the box springs.

DESCRIPTION OF THE PREFERRED EMBODIMENT

Figure 1:
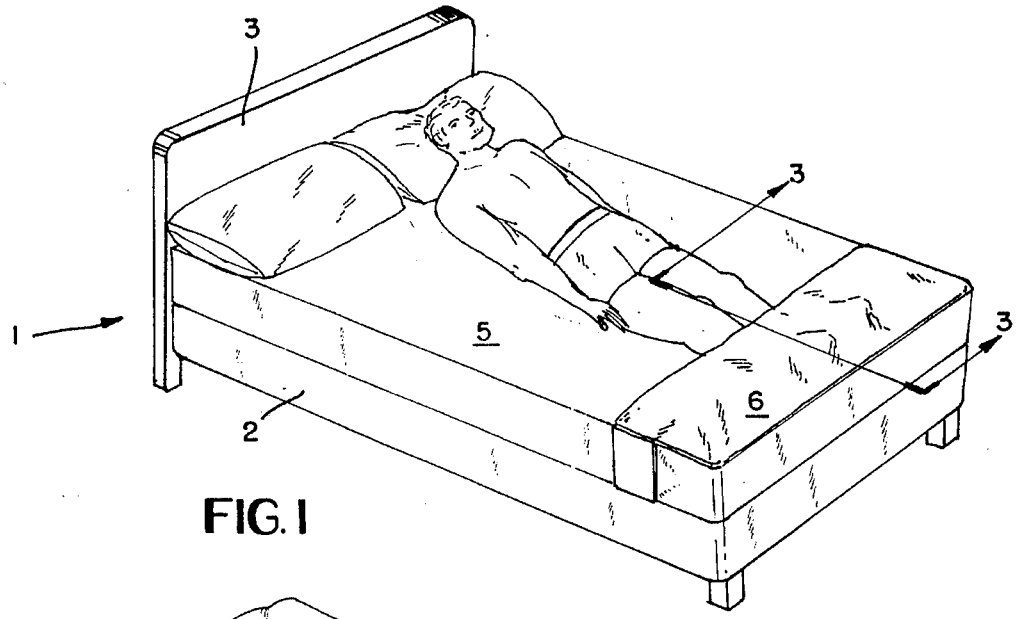
FIG. 1 is a perspective view of a conventional bed in combination with a foot warmer according to this invention.

In the drawing, the numeral 1 generally indicates a conventional bed having box springs 2 adjoined in known manner to headboard 3. Mattress 4 is situated atop box springs 2. Mattress 4 is enveloped in well known manner by means of bedsheet 5 which can be either fitted or nonfitted, as desired by the user.

Figure 2:
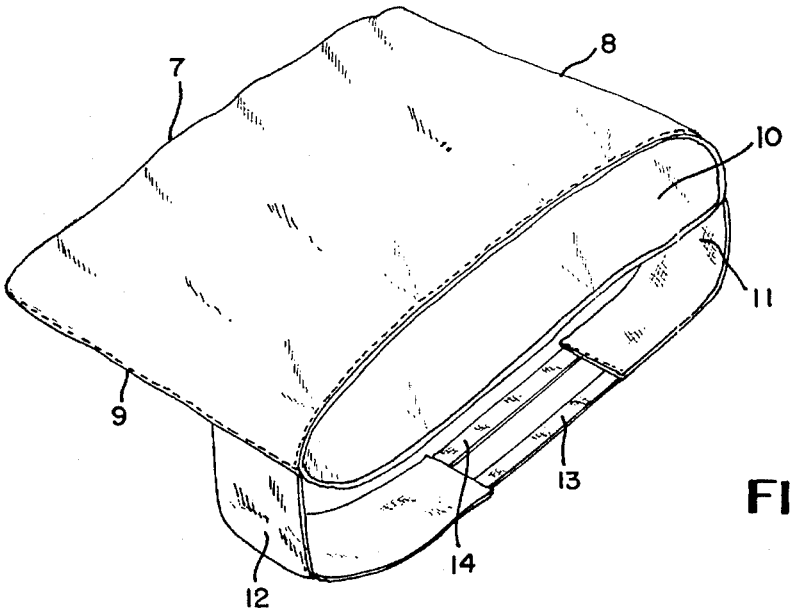
FIG. 2 is an enlarged perspective view of the foot warmer.

According to this invention, a foot warmer is provided and is shown in detail in FIG. 2. More specifically, the foot warmer comprises a fabric pocket 6 which is formed from generally rectangularly shaped fabric material. Quilt material has been determined to be highly desirable for purposes of this invention although other known heat retentive materials could be satisfactorily utilized.

As best seen in FIG. 1, the pocket portion of the foot warmer has a width approximately equal to the width of the bed on which it is used and a length extending from the foot end of the bed sufficiently to cover only the feet portions of a user, below the knees of a user, the length being substantially smaller than the length of the bed.

In order to form pocket 6, the rectangular piece of material is folded over along end edge 7 to form upper and lower fabric sheets which are sewn together along side edges 8 and 9. Pocket 6 then appears as shown in FIG. 2 which is closed on end 7 and sides 8 and 9. Of course, by this means, formed in pocket 6 is opening 10.

In order to secure pocket 6 to bed 1, attachment means is provided in the form of attachment flaps 11 and 12 which are secured along the upper ends thereof by means such as sewing, respectively, to edges 8 and 9. The lower ends of attachment straps 11 and 12 are joined together by means of a pair of expansion straps 13 and 14. Expansion straps 13 and 14 are joined at the ends thereof to the corresponding lower edges of attachment straps 11 and 12 by any suitable means such as sewing and the like. Expansion straps 13 and 14 are expandable in order to accommodate varying sizes of mattresses. The completed foot warmer then appears as shown in FIG. 2.

When used in conjunction with bedsheet 5 on mattress 4, as shown in FIG. 1, the foot warmer, as shown in FIG. 2, is placed at the foot end of the bed with opening 10 facing headboard 3. This is accomplished by slipping the attachment means in the form of attachment straps 11 and 12 and associated structure around the mattress so that the attachment means is disposed between box springs 2 and mattress 4.

Figure 3:
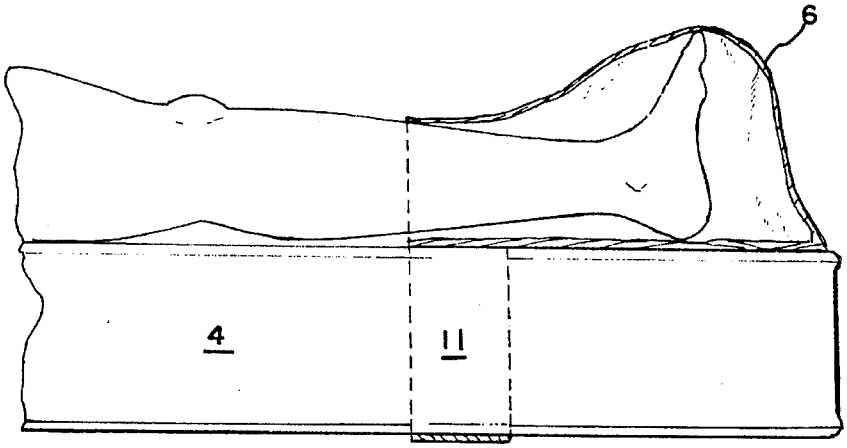
FIG. 3 is an elevational view taken along the line 3—3 in FIG. 1.

Of course, in use, one's feet are simply slipped into pocket 6 through opening 10 into the positions as shown in FIGS. 1 and 3 whereby the feet are kept warm without causing undue warming to the rest of the body and it is easily adjustable up or down the length of the bed in order to accommodate different user heights. Although the foot warmer does not necessarily need to be removed, it is easily removable from bed 1 for purposes of making up the bed or for laundering or transferral to another bed. Also the foot warmer can be manufactured to fit varying bed sizes.

We claim:

1. A foot warmer, adapted to receive a user's feet, in combination with a bed having a mattress overlying a box spring, said foot warmer comprising a pocket, having a width approximately equal to the width of the bed, and a length sufficient to cover the feet portions of a user, the length being substantially smaller than the length of the bed, said pocket having side edges, attachment straps joined respectively to said side edges and extending downwardly therefrom, an expansion strap joined at the ends thereof respectively to the ends of said attachment straps remote from said side edges, and said expansion strap being disposed between said mattress and said box spring.

2. A foot warmer according to claim 1 wherein said pocket comprises quilt material.

* * * * *